US005309191A

United States Patent [19]

Bartell et al.

[11] Patent Number: 5,309,191

[45] Date of Patent: May 3, 1994

[54] RECIRCULATION, REPLENISHMENT, REFRESH, RECHARGE AND BACKFLUSH FOR A PHOTOGRAPHIC PROCESSING APPARATUS

[75] Inventors: Roger E. Bartell, Rochester; David L. Patton, Webster; John H. Rosenburgh, Hilton; Ralph L. Piccinino, Jr., Rush, all of N.Y.

[73] Assignee: Eastman Kodak Company, Rochester, N.Y.

[21] Appl. No.: 844,806

[22] Filed: Mar. 2, 1992

[51] Int. Cl.[5] ..... G03D 13/00; G03D 3/02

[52] U.S. Cl. ..... 354/299; 354/324

[58] Field of Search ..... 354/299, 320, 324, 331

[56] References Cited

U.S. PATENT DOCUMENTS

| | | | |
|---|---|---|---|
| 3,774,521 | 11/1973 | Beck | 354/324 |
| 3,822,723 | 7/1974 | Crowell et al. | 354/324 |
| 3,831,612 | 8/1974 | Limoges | 354/328 X |
| 4,121,237 | 10/1978 | Schwartz | 354/323 |
| 4,370,046 | 1/1983 | Van Bouwel et al. | 354/324 |
| 4,519,690 | 5/1985 | Tomisawa et al. | 354/324 |
| 4,533,225 | 8/1985 | Shiga | 354/324 X |
| 4,650,308 | 3/1987 | Burbury | 354/299 |
| 4,705,378 | 11/1987 | Miyaoka et al. | 354/324 |
| 4,804,990 | 2/1989 | Jessop | 354/324 |
| 4,882,246 | 11/1989 | Ohba et al. | 354/299 |
| 4,999,660 | 3/1991 | Wright | 354/324 |
| 5,043,756 | 8/1991 | Takabayashi et al. | 354/320 |
| 5,066,570 | 11/1991 | Nakamura et al. | 354/322 |

FOREIGN PATENT DOCUMENTS

| | | | |
|---|---|---|---|
| 0222583 | 4/1986 | European Pat. Off. | G03D 3/10 |
| WO-A-91/17482 | 11/1991 | PCT Int'l Appl. | G03D 3/06 |
| 1438720 | 6/1975 | United Kingdom | 354/324 |

OTHER PUBLICATIONS

JP57165835, Patent Abstracts of Japan (Konishiroku Shashin Kogyo), vol. 7, No. 6 (P-167) Jan. 11, 1983.

*Primary Examiner*—D. Rutledge

*Attorney, Agent, or Firm*—Ronald Reichman

[57] ABSTRACT

An apparatus for processing photosensitive materials, which comprises: a tank through which a processing solution is pumped; a rack having integral means to facilitate its insertion and removal from the tank, the rack and the tank are relatively dimensioned so that a small volume for holding processing solution and photosensitive material is formed between the rack and the tank; means for filling the small volume and the circulating means, from the lowest elevation point of the small volume and the lowest elevation point of the circulating means, with processing solution to prevent air from being entrapped in the processing apparatus; and means for emptying the small volume and the circulating means, from the lowest elevation point of the small volume and the lowest elevation point of the circulating means, of processing solution to prevent processing solution and particulate matter from being entrapped in the processing apparatus.

13 Claims, 4 Drawing Sheets

RECIRCULATION, REPLENISHMENT, REFRESH, RECHARGE AND BACKFLUSH FOR A PHOTOGRAPHIC PROCESSING APPARATUS

CROSS REFERENCE TO RELATED APPLICATIONS

Reference is made to commonly assigned copending patent applications: Ser. No. 07/844,820 entitled "A DRIVING MECHANISM FOR A PHOTOGRAPHIC PROCESSING APPARATUS" filed herewith in the names of Ralph L. Piccinino, Jr., David L. Patton, Roger E. Bartell, Anthony Earle, and John H. Rosenburgh, Pat. No. 5,179,404 entitled "ANTI-WEB ADHERING CONTOUR SURFACE FOR A PHOTOGRAPHIC PROCESSING APPARATUS" filed herewith in the names of Roger E. Bartell, Ralph L. Piccinino, Jr., John H. Rosenburgh, Anthony Earle, and David L. Patton, Ser. No. 07/844,815 entitled "A RACK AND A TANK FOR A PHOTOGRAPHIC PROCESSING APPARATUS" filed herewith in the names of David L. Patton, Roger E. Bartell, John H. Rosenburgh and Ralph L. Piccinino, Jr., and Ser. No. 07/844,355 entitled "A SLOT IMPINGEMENT FOR A PHOTOGRAPHIC PROCESSING APPARATUS" filed herewith in the names of John H. Rosenburgh, David L. Patton, Ralph L. Piccinino, Jr., and Anthony Earle.

BACKGROUND OF THE INVENTION

1. Field of the Invention

The invention relates to the field of photography, and particularly to a photosensitive material processing apparatus.

2. Description of the Prior Art

The processing of photographic film involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 litres of each processing solution. A small photofinishing apparatus or microlab utilizes tanks that may contain less than 10 litres of processing solution.

The chemicals contained in the photographic solution: cost money to purchase; change in activity and leach out or season during the photographic process; and after the chemicals are used the chemicals must be disposed of in an environmentally safe manner. Thus, it is important in all sizes of photofinishing apparatus to reduce the volume of processing solution. The prior art utilized various types of replenishing systems that add or subtract specific chemicals to the photographic solution to maintain a consistency of photographic characteristics in the material developed. It is possible to maintain reasonable consistency of photographic characteristics only for a certain period of replenishment. After a photographic solution has been used a given number of times, the solution is discarded and a new photographic solution is added to the tank.

Activity degradation due to instability of the chemistry, or chemical contamination, after the components of the photographic solution are mixed together causes one to discard the photographic solution in smaller volume tanks more frequently than larger volume tanks. Some of the steps in the photographic process utilize photographic solutions that contain chemicals that are unstable, i.e., they have a short process life. Thus, photographic solutions in tanks that contain unstable chemicals are discarded more frequently than photographic solutions in tanks that contain stable chemicals.

The prior art realized that if the volume of the various tanks contained within various sizes of photographic processing apparatus were reduced the same amount of film or photographic paper may be processed, while reducing the volume of photographic solution that was used and subsequently discarded.

Processing solutions are usually poured into the top of large tanks that comprise large photographic processing apparatus. Air is often trapped in the various tanks, conduits, pumps, filters, etc. of the large photographic processing apparatus. This trapped air causes an air lock, which does not allow the processing solution to be consistently circulated through the photographic processing apparatus. The above did not pose a major problem in large photofinishing apparatus since the trapped air had space to be eliminated from the top of the tank. The trapped air was eliminated from the filter by losing the top of the filter and allowing the air to escape with some of the processing solution. The conduits were large enough so that air was free to move through the conduits.

If processing solutions were poured into the top of smaller volume tanks the above problem was exacerbated. The smaller space caused more air to be trapped in the various components of the smaller photofinishing apparatus. If too much air was trapped the processing solution may become airbound and fail to circulate properly through the processing apparatus. A further problem is that the trapped air may break up into smaller air bubbles causing foaming or sudsing of the processing solution which results in non-uniform photosensitive development; excessive chemical oxidation and processing solution overflow.

As processing solution is added the viscosity, capillary action and meniscus interacting with the tank walls, conduits, filters, etc. prevents processing solution from displacing the air resident in the tank walls, conduits, filters, etc.

When processing solutions are pumped or drained from the various tanks, filters, conduits, pumps, etc. of large photographic processing apparatus portions of the processing solution and particulate matter are usually trapped in the tanks, filters, conduits, pumps, etc. of the photographic processing apparatus. If too much particulate matter is present in the photographic processing apparatus, the particulate matter will be recirculated back into the photosensitive material. This may streak and/or scratch the photosensitive material. The particulate matter may also become trapped in nozzles or orifices of the photographic processing apparatus restricting circulation of the processing solution. The above causes insufficient processing solution flow for proper reaction with the photosensitive material and nonuniform development of the photosensitive material.

The foregoing did not pose a major problem in large photographic processing apparatus, since the size of the various components of the photofinishing apparatus were large enough to allow the particulate matter to travel through the components of the photographic processing apparatus. However, in smaller volume photographic processing apparatus, the tanks, nozzles, orifices, etc. are not large enough to allow particulate matter to escape and circulate freely through the photographic processing apparatus.

SUMMARY OF THE INVENTION

This invention overcomes the disadvantages of the prior art by providing a low volume photographic material processing apparatus that is configured in a manner such that when the photographic material processing apparatus is filled with processing solution no spaces exist to trap air and form air locks or air pockets. The processing apparatus is also designed in a manner such that when the apparatus is drained of processing solution no spaces exist to trap particulate matter of processing solution.

The foregoing is accomplished by providing an apparatus for processing photosensitive materials which comprises: a tank through which a processing solution is pumped; a rack having integral means to facilitate its insertion and removal from the tank, the rack and the tank are relatively dimensioned so that a small volume for holding processing solution and photosensitive material is formed between the rack and the tank; means for circulating the processing solution through the small volume; means for filling the small volume and the circulating means from, the lowest elevation point of the small volume and the lowest elevation point of the circulation means, with processing solution to prevent air from being entrapped in the processing apparatus; and means for emptying the small volume and the circulating means, from the lowest elevation point of the small volume and the lowest elevation point of the circulating means, of processing solution to prevent processing solution and particulate matter from being entrapped in the processing apparatus.

DESCRIPTION OF THE PREFERRED EMBODIMENT

Figure 1:
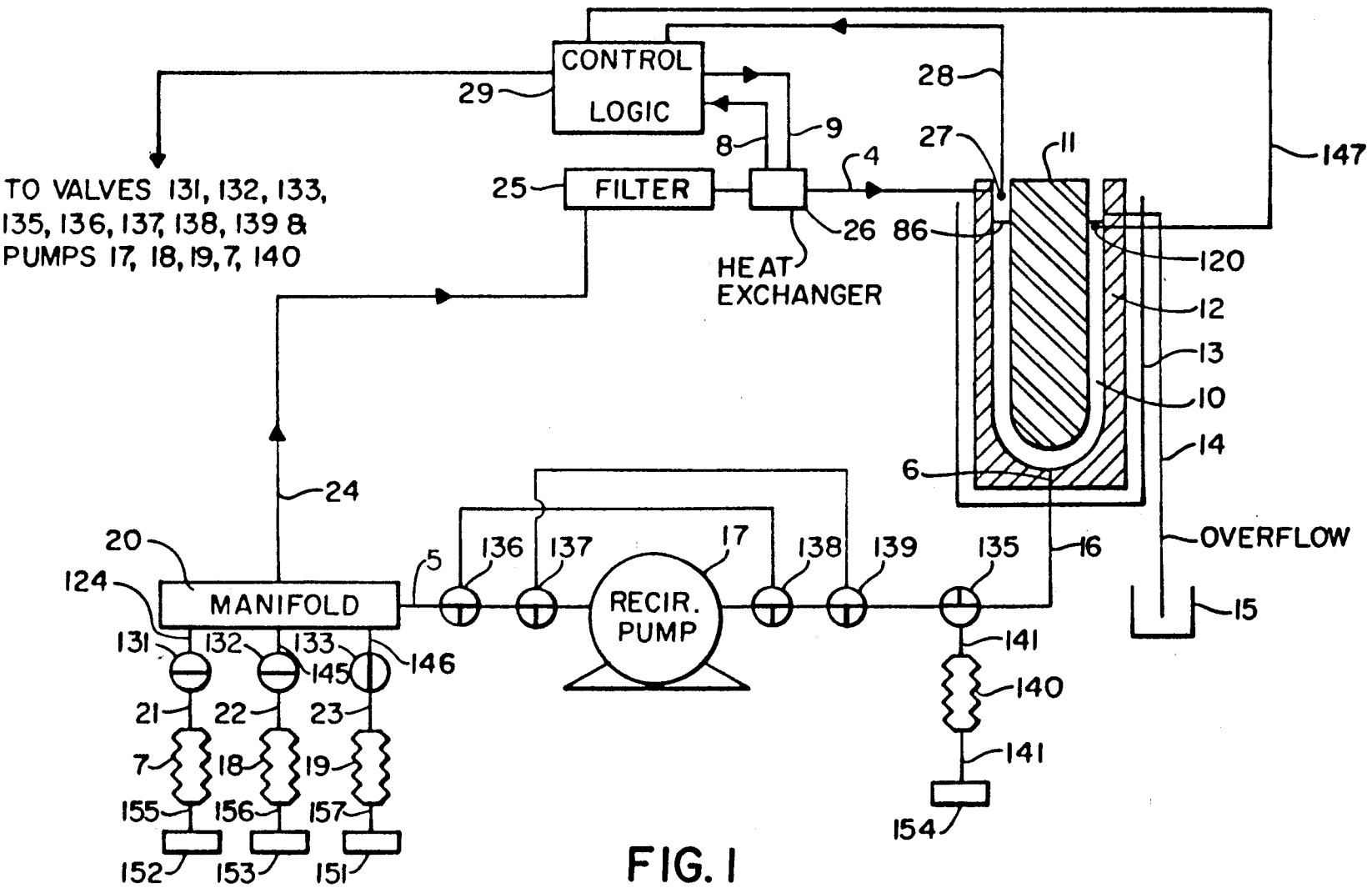
FIG. 1 is a schematic drawing of the apparatus of this invention in the fill mode.

Referring now to the drawings in detail, and more particularly to FIG. 1, the reference character 11 represents a rack 11, which may be easily inserted and removed from tank 12. Rack 11 and tank 12 form a low volume photosensitive material processing vessel 13.

When rack 11 is inserted in tank 12, a space 10 is formed. Rack 11 and tank 12 are designed in a manner to minimize the volume of space 10. The outlet 6 of vessel 13 is connected to recirculating pump 17 via conduit 16. Recirculating pump 17 is coupled to manifold 20 via conduit 5 and manifold 20 is coupled to filter 25 via conduit 24. Filter 25 is connected to heat exchanger 26 and heat exchanger 26 is connected to control logic 29 via wire 9. Control logic 29 is connected to heat exchanger 26 via wire 8 and sensor 27 is connected to control logic 29 via wire 28. Overflow sensor 120 is connected to logic 29 via wire 147. Metering pumps 7, 18 and 19 are respectively coupled to valves 131, 132 and 133 via conduits 21, 22 and 23. Valves 131, 132 and 133 are three position manually or automatically actuated valves. Valve 131 is connected to manifold 20 via conduit 124 and valve 132 is connected to manifold 20 via conduit 145. Valve 133 is connected to manifold 20 via conduit 146. Pumps 7, 18 and 19 are respectively coupled to processing solution replenishment tanks 152, 153, and 151 via conduits 155, 156 and 157.

The photographic processing chemicals that comprise the photographic solution are placed in tanks 152, 153 and 151. Metering pumps 7, 18 and 19, valves 131, 132 and 133 and tanks 152, 153 and 151 are used to place the correct amount of chemicals in manifold 20. Manifold 20 introduces the photographic processing solution into conduit 24.

The photographic processing solution flows into filter 25 via conduit 24. Filter 25 removes particulate matter and dirt that may be contained in the photographic processing solution. After the photographic processing solution has been filtered, the solution enters heat exchanger 26.

Sensor 27 senses the temperature of the solution and transmits the temperature of the solution to control logic 29 via wire 28. For example, control logic 29 is the series CN 310 solid-state temperature controller manufactured by Omega Engineering, Inc. of 1 Omega Drive, Stamford, Conn. 06907. Logic 29 compares the solution temperature sensed by sensor 27 and the temperature that exchanger 26 transmitted to logic 29 via wire 8. Logic 29 will inform exchanger 26 via wire 9 to add or remove heat from the solution. Thus, logic 29 and heat exchanger 26 modify the temperature of the solution and maintain the solution temperature at the desired level.

When the processing solution goes above level 86 in tank 12, overflow sensor 120 will transmit a signal to control logic 29 via wire 147. Control logic 29 will transmit a signal to valves 131, 132 and 133 and to pumps 7, 18 and 19, requesting that the aforementioned pumps be turned off and the aforementioned valves be closed. Logic 29 is also coupled to valves 135, 136, 137, 138 and 129, and to pumps 17 and 140.

When vessel 13 contains too much solution the excess solution will be removed by drain 14 and flow into reservoir 15. The remaining solution will circulate through space 10 and reach outlet line 6. Thereupon, the solution will pass from outlet line 6 to conduit line 16 to three position manual or automatic valve 135. Conduit 141 connects pump 140 to valve 145 and drain tank 154.

Valve 135 is connected to valve 139 and valve 139 is connected to valve 138. Valve 139 is also connected to valve 137. Valve 138 is connected to recirculation pump 17 and valve 136. Valve 136 is also connected to manifold 20 and valve 137. Valve 137 is also connected to pump 17.

FIG. 1 depicts the various components of the apparatus of this invention in the fill processing solution mode. In the fill mode recirculation pump 17 is off, and tank 151 will hold processing solution. When valves 131 and 132 are closed and valve 133 is open the processing solution from tank 151 will be pumped by pump 19 into manifold 20 or pressure fed from tank 151 into manifold 20. Thereupon, the processing solution will diverge in two directions displacing the trapped air. The first direction is via valve 136, valve 137, recirculation pump 17, valve 138, valve 139, valve 135, conduit 16, outlet 6 into space 10. At the same time as the processing solution enters conduit 16, the processing solution will enter conduit 24 and begin to travel in the second direction. The second direction is via conduit 24, filter 25, heat exchanger 26, conduit 4 into space 10. When the processing solution traveling in the first direction reaches level 86 in space 10, sensor 120 will inform logic 29 that space 10 is full. At the moment that space 10 is full, the processing solution travelling in the second direction will just have reached the end of conduit 4. Thus, at this time no processing solution travelling in the second direction will enter space 10. The above mode of filling does not permit air entrapment because the processing solution rises, vertically in the apparatus without directional changes greater than 90 degrees from the vertical.

Thus, the apparatus of this invention is filled with processing solution inputted to the lowest elevation point of the apparatus. The areas of the apparatus of this invention that direct the processing solution at angles other than vertical, i.e., conduits, manifold 20, filter 24, heat exchanger 26, do not contain any spaces in which air may be trapped.

When solution level sensor 120 senses processing solution at level 86, pump 19 is shut off and valve 133 is closed. At this point, the apparatus of the invention will be filled with processing solution. If the solution contained in tank 151 is pressurized, the closing of valve 133 will stop pressurized processing solution from tank 151 from entering manifold 120. The aforementioned valves and pumps may be turned on-and off manually or automatically controlled via control logic 29.

Figure 2:
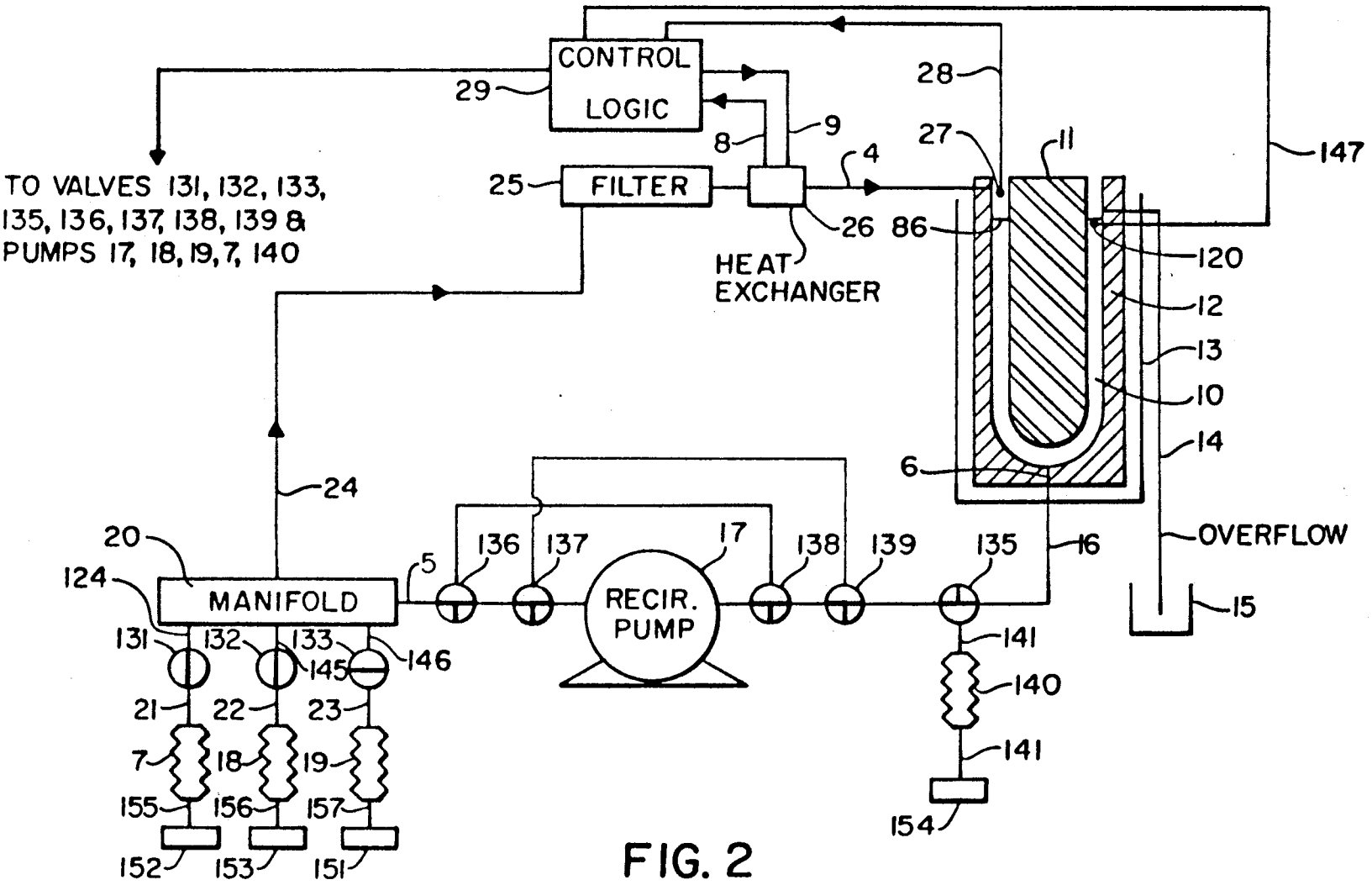
FIG. 2 is a schematic drawing of the apparatus of this invention in the circulation mode.

FIG. 2 depicts the various components shown in FIG. 1 set for the circulation mode.

In the circulation mode, valves 131 and 132 are open, valve 133 is closed, recirculation pump 17 is turned on (manually or automatically by control logic 29). Processing solution flows through valve 137, valve 136, manifold 120, conduit 24, filter 25, heat exchanger 26, conduit 4, into space 10, through space 10 to conduit 16, to valve 135 to valve 139 through valve 138 to recirculation pump 17. In this mode, pumps 7 and 18 add fresh replenishment processing solution from tanks 152 and 153 through valves 131 and 132 into manifold 20. This allows the fresh replenishment processing solution to combine with the processing solution previously in the apparatus.

Figure 3:
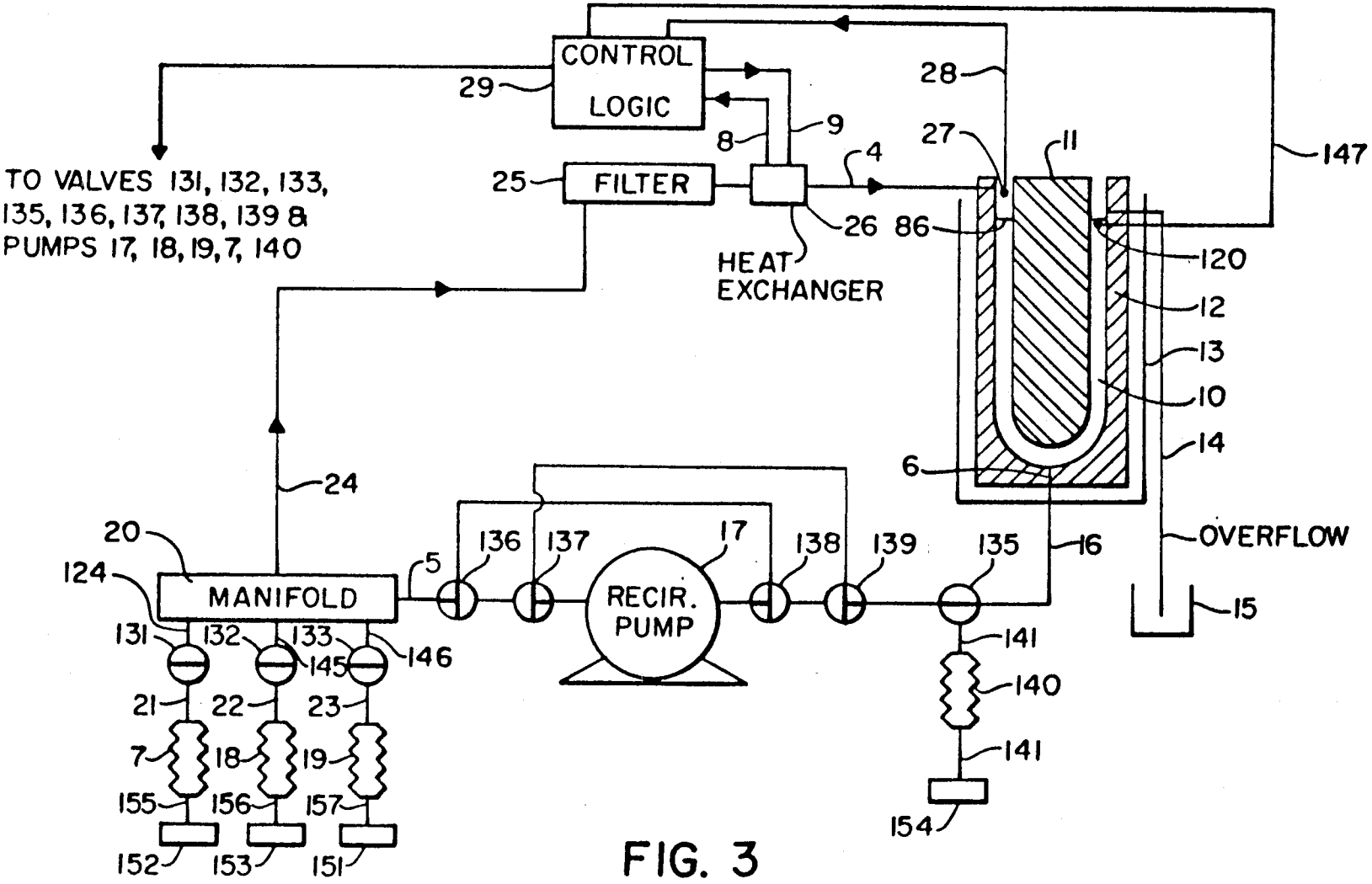
FIG. 3 is a schematic drawing of the apparatus of this invention in the backflush mode.

FIG. 3 depicts the various components of the apparatus of this invention in the backflush mode. In the backflush mode valves 136, 137, 138 and 139 are placed in the backflush position causing the circulating processing solution to reverse the direction of flow shown in FIG. 1 to the direction of flow described in FIG. 3. Processing solution will flow from recirculation pump 17 through valves 137, 139 and 135, through conduit 16 and outlet line 6 into space 10, out of space 10, to heat exchanger 24, through filter 25 into manifold 20 through valves 136 and 138, and back into recirculation pump 17.

Figure 4:
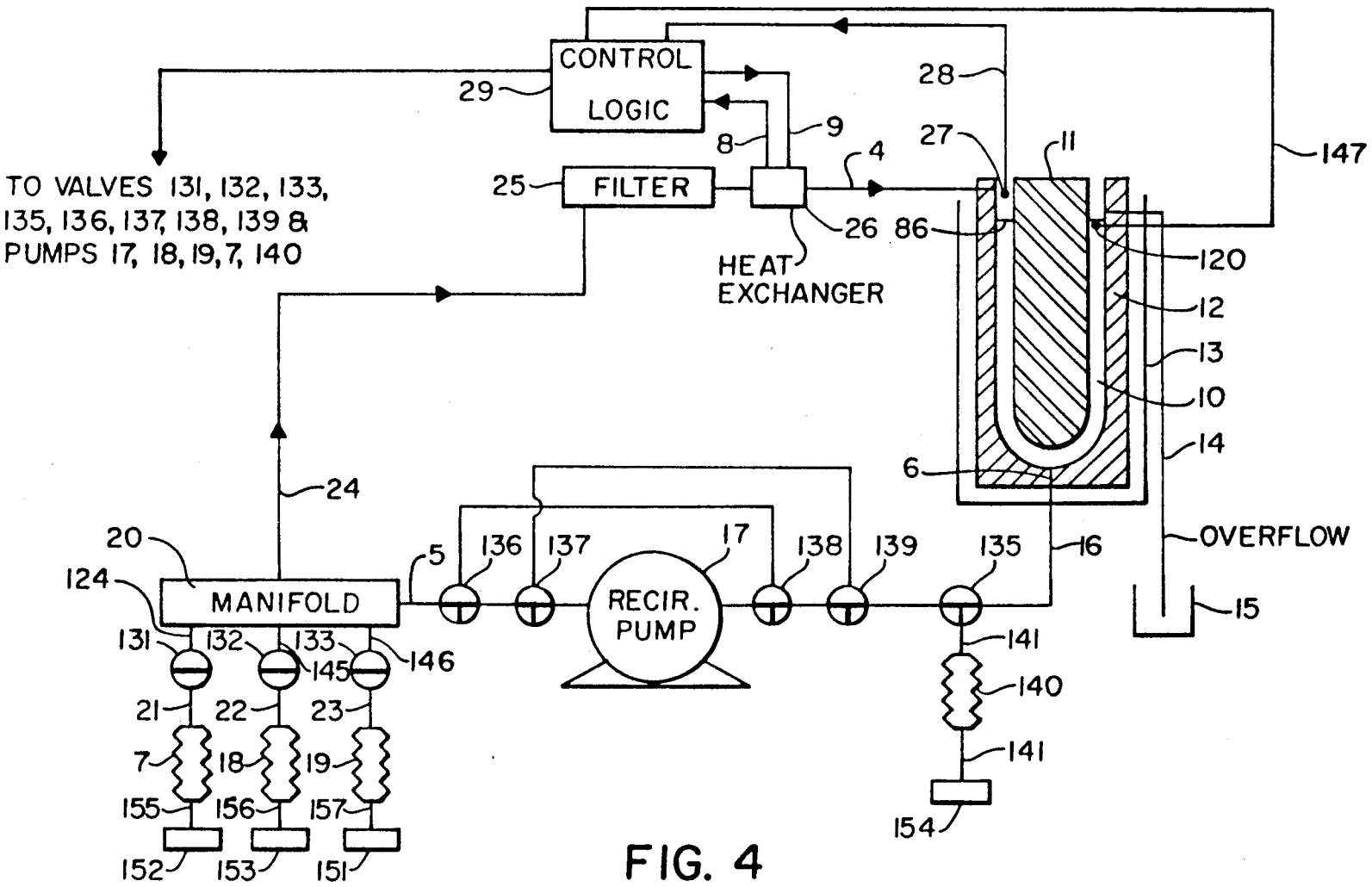
FIG. 4 is a schematic drawing of the apparatus of this invention in the drain mode.

FIG. 4 depicts the various components of the apparatus of this invention depicted in FIG. 1 in the drain mode. In the drain mode valves 131, 132 and 133 are closed. Valve 135 is placed in the drain position. When the above configuration is set, gravity may drain processing solution from space 10, outlet 6, conduit 16, valve 135 to tank 154. If one would want the processing solution to drain at a more rapid rate, pump 140 may be turned on to cause processing solution to drain more rapidly into tank 154.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

What is claimed is:

1. An apparatus for processing photosensitive materials, which comprises:

a tank through which a processing solution is pumped;

a rack having integral means to facilitate its insertion and removal from said tank, said rack and said tank are relatively dimensioned so that a small volume for holding processing solution and photosensitve material is formed between said rack and said tank;

means for circulating the processing solution through the small volume;

means for filling the small volume and said circulating means, from the lowest elevation point of the small volume and the lowest elevation point of the circulation means, with processing solution to prevent air from being entrapped in the processing apparatus;

means for emptying the small volume and said circulating means, from the lowest elevation point of the small volume and the lowest elevation point of said circulating means, of processing solution to prevent processing solution and particulate matter from being entrapped in the processing apparatus and means for controlling said emptying means.

2. The apparatus claimed in claim 1, wherein said filling means comprising:

a container containing fresh processing solution; and a pump coupled to said container to pump the processing solution into the small volume and said circulation means.

3. The apparatus claimed in claim 1, wherein said filling means comprises:

a container containing fresh processing solution;

means for causing the processing solution to flow from said container into the small volume and said circulation means; and a valve coupled to the small volume and said circulation means to allow the processing solution to flow into the small volume and said circulation means.

4. An apparatus for processing photosensitive materials, which comprises:

a tank through which a processing solution is pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume;

means for filling the small volume and said circulating means, from the lowest elevation point of the small volume and the lowest elevation point of said circulation means, with processing solution to prevent air from being entrapped in the processing apparatus;

means for emptying the small volume and said circulating means, from the lowest elevation point of the small volume and the lowest elevation point of the small volume and the lowest elevation point of said circulating means, of processing solution to prevent processing solution and particulate matter from being entrapped in the processing apparatus;

means for controlling said emptying means and means for backflushing said circulating means and the small volume to remove any particulate matter.

5. The apparatus claimed in claim 4, wherein said backflushing means comprises: a plurality of valves coupled to said circulation means to control the direction of processing solution flow in the small volume and in said circulation means.

6. The apparatus claimed in claim 1, further including means for controlling said filling means.

7. The apparatus claimed in claim 1, further including means for controlling said circulating means.

8. The apparatus claimed in claim 5, further including means for controlling said backflushing means.

9. The apparatus claimed in claim 8, further including a level sensor coupled to said controlling means, said sensor senses the processing solution level in the small volume.

10. The apparatus claimed in claim 1, wherein said circulation means comprises:

a pump for recirculating the processing solution;

conduits connected to said pump, and said tank for transporting the processing solution; and a filter connected to said conduit for removing particulate matter from the processing solution, wherein, the processing solution volume used by said circulation means does not exceed the small volume for holding processing solution.

11. The apparatus claimed in claim 10, further including:

a plurality of metering pumps for metering specified amounts of chemicals; and a manifold coupled to said conduit and said metering pumps for dispensing additional processing solution to the small volume.

12. The apparatus claimed in claim 11, further including a heat exchanger that rapidly regulates the temperatures of the processing solution.

13. The apparatus claimed in claim 11, wherein said tanks have an overflow conduit coupled to a reservoir to maintain a consistent processing solution level.

* * * * *

UNITED STATES PATENT AND TRADEMARK OFFICE

CERTIFICATE OF CORRECTION

PATENT NO. : 5,309,191
DATED : May 3, 1994
INVENTOR(S) : Bartell, et. al.

It is certified that error appears in the above-indentified patent and that said Letters Patent is hereby corrected as shown below:

In Column 6, line 23, delete "the circulation" and insert --said circulation--.
In Column 6, line 36, delete "comprising" and insert --comprises--.
In Column 7, lines 1–2, delete "the small volume and the lowest elevation point of".

Signed and Sealed this

Thirtieth Day of August, 1994

*Attest:*

Bruce Lehman

BRUCE LEHMAN

*Attesting Officer*

*Commissioner of Patents and Trademarks*